US011999445B1

(12) United States Patent
Farrell

(10) Patent No.: US 11,999,445 B1
(45) Date of Patent: Jun. 4, 2024

(54) CONVERTIBLE SEATING SYSTEM WITH RATCHETING SEATING SURFACE FOR MARINE VESSELS

(71) Applicant: Brunswick Corporation, Mettawa, IL (US)

(72) Inventor: Kevin Farrell, New Smyrna Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 365 days.

(21) Appl. No.: 17/400,981

(22) Filed: Aug. 12, 2021

Related U.S. Application Data

(60) Provisional application No. 63/119,873, filed on Dec. 1, 2020.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS

| | | | |
|---|---|---|---|
| 1,224,982 | A | 5/1917 | Washeim |
| 3,743,350 | A | 7/1973 | Allen |
| 4,099,768 | A | 7/1978 | Amos |
| 4,693,204 | A | 9/1987 | Klein |
| 4,738,217 | A | 4/1988 | Smith |
| 4,926,783 | A | 5/1990 | Lathers |
| 5,329,871 | A | 7/1994 | Gibbs |
| 5,799,605 | A | 9/1998 | Huse |
| 5,913,571 | A | 6/1999 | Dystra et al. |
| 6,283,059 | B1 | 9/2001 | Scully, Jr. |
| 6,647,916 | B2 | 11/2003 | Neese et al. |
| 6,789,494 | B2 | 9/2004 | Neese et al. |

(Continued)

FOREIGN PATENT DOCUMENTS

| | | | |
|---|---|---|---|
| DE | 60207263 | 7/2006 | |
| DE | 60207263 T2 * | 7/2006 | ..... B60N 2/20 |
| WO | 2019222749 | 11/2019 | |

*Primary Examiner* — Anthony D Wiest
(74) *Attorney, Agent, or Firm* — Andrus Intellectual Property Law, LLP

(57) ABSTRACT

A convertible seating system for a marine vessel that is movable between a stowed configuration and a deployed configuration is provided. The convertible seating system includes a backrest component that is pivotably coupled to a deck portion of the marine vessel. The backrest component includes a backrest cushion support portion and a projecting portion that extends from the backrest cushion support portion. The convertible seating system further includes a seat component that is pivotably coupled to a recessed compartment formed in the deck portion. The seat component includes a seat cushion support portion and a locking portion that extends from the seat cushion support portion. Pivoting the backrest component from the stowed configuration to the deployed configuration causes the projecting portion to engage the locking portion and the seat component to pivot such that the seat cushion support portion moves upwardly relative to the deck portion in the deployed configuration.

20 Claims, 8 Drawing Sheets

(56) References Cited

U.S. PATENT DOCUMENTS

| | | | |
|---|---|---|---|
| 7,107,927 | B2 | 9/2006 | Hopper et al. |
| 7,121,218 | B2 | 10/2006 | Stinson et al. |
| 7,156,442 | B2 | 1/2007 | McManus |
| 7,367,616 | B2 | 5/2008 | Summerford |
| 7,513,211 | B1 | 4/2009 | Farb et al. |
| 7,677,668 | B2 | 3/2010 | Olsen et al. |
| 8,028,641 | B1 | 10/2011 | Sly |
| 8,113,137 | B2 | 2/2012 | Thompson |
| 8,517,466 | B1 | 8/2013 | Wizorek et al. |
| 8,899,169 | B1 | 12/2014 | Jaziri |
| 9,021,975 | B1 | 5/2015 | Fodor et al. |
| 9,073,608 | B1 | 7/2015 | Foss et al. |
| 9,260,166 | B1 | 2/2016 | Fodor et al. |
| 9,821,887 | B1 | 11/2017 | Wilson et al. |
| 10,085,566 | B1 | 10/2018 | Gallant |
| 10,207,776 | B1 | 2/2019 | Downey et al. |
| 10,471,859 | B2 | 11/2019 | Harrison, III et al. |
| 10,486,777 | B1 | 11/2019 | Barbier et al. |
| D870,016 | S | 12/2019 | Wilson et al. |
| 10,556,645 | B1 | 2/2020 | Levin |
| 11,286,022 | B1 | 3/2022 | Freer |
| 2021/0214052 | A1* | 7/2021 | Mast ..... B63B 29/04 |
| 2022/0258835 | A1 | 8/2022 | Curts |

* cited by examiner

CONVERTIBLE SEATING SYSTEM WITH RATCHETING SEATING SURFACE FOR MARINE VESSELS

CROSS-REFERENCE TO RELATED APPLICATION

The present application claims the benefit of and priority to U.S. Provisional Application Ser. No. 63/119,873, filed Dec. 1, 2020, which application is hereby incorporated by reference in its entirety.

FIELD

The present disclosure relates to marine vessels and watercraft, and more particularly, pertains to a convertible seating system for marine vessels and watercraft that is provided with a ratcheting seating surface.

BACKGROUND

U.S. Pat. No. 5,799,605 discloses an expandable seat and storage unit particularly adapted for use in a boat. The expandable seat has a base unit which defines a storage area. A frame is slidably mounted within the base and can slide with respect to the base to expand the length of the seat to form a bed. The frame is locked into the base by the back cushion of the seat. By removing the back cushion, the frame section can be slid out of the base and then the back cushion can be used along with the seat cushion to form a bed. The frame has side members which extend generally perpendicular from the side edges of the front face of the frame and ride in tracks formed in the base unit. The tracks are along the sides of the base unit and do not interfere with the storage area. Further, the tracks are formed integrally in the base unit to facilitate easy inexpensive manufacture and operation.

U.S. Pat. No. 7,513,211 discloses a seat assembly for use in boats. The seat assembly includes a pair of seating platforms with a reclining seat back and a sliding seat bottom. A removable section is inserted between the seat bottom and the seat back to create a long recliner. A central panel and pad are set between the seating platforms to create a large surface area sunpad. The seating platforms are hollow to allow for storage of the central panels and pads and the removable sections.

U.S. Pat. No. 8,517,466 discloses a convertible boat seat that transforms from a standard bench-style seat configuration capable of accommodating multiple occupants to a lounger that allows a single occupant to comfortably lounge without impeding into the available deck space. A convertible boat seat comprises a chaise lounge type seat having a plurality of configurable components including a two-piece back rest, a configurable armrest, a hinging bench seat assembly, and an inclined chaise end forming a lounge backrest adapted with a pivoting armrest. The two-piece backrest includes first and second backrest components that are each configurable between a raised position and a lowered position. The inclined chaise end includes a pivoting armrest configurable between a stowed, out-of-the-way position, and a deployed position wherein it functions as a lounge armrest. A hinging bench seat includes first and second hingedly connected seat components that are configurable between a generally flat configuration for bench seating and a raised configuration wherein the lounger's knees are supported in a partially bent lounging position. On an opposing end of the inclined chaise end is an armrest configurable between a raised position wherein it functions as an armrest when the seat is configured for bench-style seating, and a lowered position wherein it is stowed generally flush with the bench seat surface for providing increased leg room while lounging.

U.S. Pat. No. 8,899,169 discloses a platform for a vessel that includes integrated and stowable seating. The platform comprises a platform surface, at least one seating recess, and at least one seat back panel. The seating recess is disposed below the platform surface. The seat back panel has an inner surface and an opposing outer surface and is pivotably attached to the seating recess to provide a plurality of operative positions, including an open seating position and a closed position. In the closed position, the outer surface of the seat back panel is substantially flush with respect to the platform surface, providing a continuous and unobstructed boarding/swimming platform. The open seating position provides an aftward seating configuration. Both the seating recess and seat back panel can removably receive cushions for added comfort and support of the user. The configuration maximizes usable platform space when the seat back panels are closed.

U.S. Pat. No. 9,021,975 discloses a seating system for marine vessels and watercraft including a chair having a backrest and a seat bottom and a lounge extension element wherein a first end of the extension element is hingeably attached to and extends from the seat bottom and wherein a second end of the extension element is configured to be hingeably attached to a first rigid structure such as a bulkhead on a watercraft. The seating system is convertible between a forward-facing seat configuration and an aft-facing lounger configuration. In the aft-facing lounger configuration, the extension element and the seat bottom are substantially parallel to one another. In the forward-facing seat configuration, the extension element is substantially upright and at an acute angle with respect to said seat bottom.

U.S. Pat. No. 9,073,608 discloses a seating system for watercraft having a base supporting a seating surface and a backrest pivotably attached to the base. The backrest pivots about the seating surface to provide a plurality of selectable seating positions. The backrest is pivotably attached to the base by an arm attached to the side of the backrest. The arm engages a guide member attached to the base, the guide member having one or more positional slots corresponding to the plurality of selectable seating positions. The backrest can be positioned upright, at an angle, or flat with respect to the seating surface to provide a plurality of seating configurations including simultaneous forward and aft seats, an aft-facing lounge seat and a sunpad. The seating surface comprises hingeable seat cushions permitted access to storage compartments inside the base. The seating system can be installed adjacent to a bulkhead on a watercraft to provide an aft-facing lounge seat.

U.S. Pat. No. 9,260,166 discloses a seat for a marine vessel capable of multiple positions while maintaining a hidden or concealed look when closed. The seat has a seat back hingeably attached to a seat bottom and a seat back cap hingeably attached to a leading edge of the seat back. The seat is operable between a plurality of selected positions including an open position and a closed position. In the open position, the seat back is upright and the seat provides at least one traditional seating surface. In the closed position, the seat back rests substantially parallel on the seat bottom and a rear surface of the seat back functions as a sun pad. In the closed position, the seat back cap is deployed over a leading edge of the seat bottom and the leading edge of the seat back to conceal the seat. A positionable leg extension pad extends from the seat bottom.

U.S. Pat. No. 9,821,887 discloses a convertible seating system for a marine vessel includes a frame and a seat mounted on the frame and defining a first support surface. A backrest is configured for movement relative to the seat and the frame between a first position and a second position. In the second position, the backrest defines a second support surface lying generally parallel and vertically displaced relative to the first support surface.

U.S. Pat. No. 10,085,566 discloses a marine vessel that has a deck surface having a recessed cavity; a seat module having a seating member, an engagement member, and a hinge that couples the seating member to the engagement member; and a retainer configured to retain the engagement member with respect to the recessed cavity. The seating member is pivotable about the hinge into and between a closed position in which the seating member lies flush with the deck surface and covers the recessed cavity and an open position in which the seating member provides seating for user and the recessed cavity is exposed and provides leg room for the user.

U.S. Pat. No. 10,486,777 discloses a seating system that includes a base, and a seat mounted on the base and defining a seating surface. A backrest is configured for movement relative to the base and the seat between a first position and a second position by a backrest transfer arrangement having a movable pivot axis configuration. In the second position, the backrest defines a working surface spaced above and lying generally parallel to the seating surface.

Each of the above patents is hereby incorporated herein by reference in its entirety.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to one example of the present disclosure, a convertible seating system for a marine vessel that is movable between a stowed configuration and a deployed configuration is provided. The convertible seating system includes a backrest component that is pivotably coupled to a deck portion of the marine vessel. The backrest component includes a backrest cushion support portion and a projecting portion that extends from the backrest cushion support portion. The convertible seating system further includes a seat component that is pivotably coupled to a recessed compartment formed in the deck portion. The seat component includes a seat cushion support portion and a locking portion that extends from the seat cushion support portion. Pivoting the backrest component from the stowed configuration to the deployed configuration causes the projecting portion to engage the locking portion and the seat component to pivot such that the seat cushion support portion moves upwardly relative to the deck portion in the deployed configuration.

According to another example of the present disclosure, a convertible seating system for a marine vessel that is movable between a stowed configuration and a deployed configuration is provided. The convertible seating system includes a recessed compartment including multiple sidewalls formed in a deck portion of the marine vessel, a seat component that is pivotably coupled to one of the sidewalls, a deck component that is located above at least a portion of the recessed compartment, and a backrest component that is pivotably coupled to the deck component. Pivoting the backrest component relative to the deck component from the stowed configuration to the deployed configuration engages the seat component to cause the seat component to pivot.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity, and understanding. No unnecessary limitations are to be inferred therefrom beyond the requirement of the prior art because such terms are used for descriptive purposes only and are intended to be broadly construed.

Figure 1:
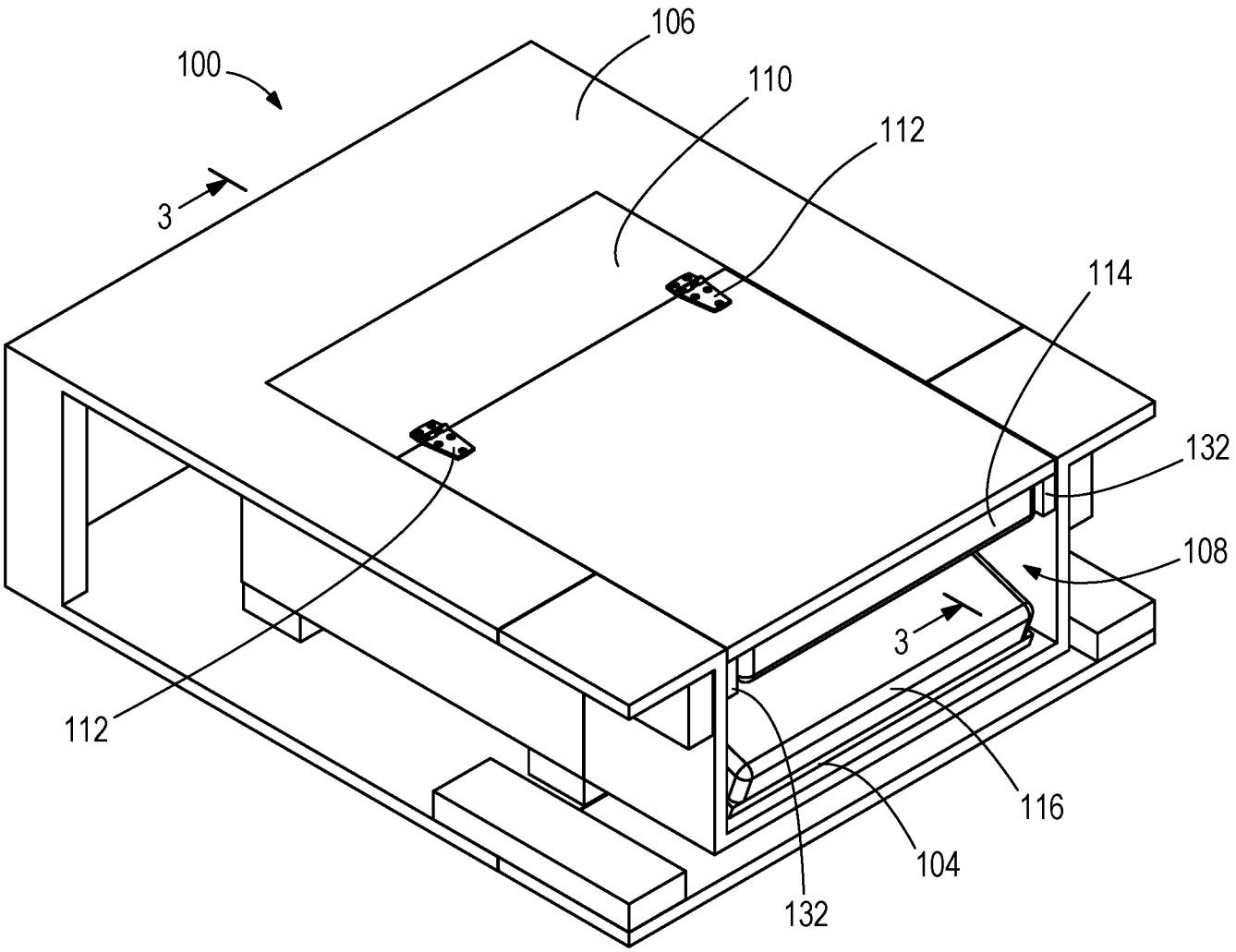
FIG. 1 is a perspective view of a boat provided with a convertible seating system in accordance with the present disclosure and showing a stowed configuration.
Figure 2:
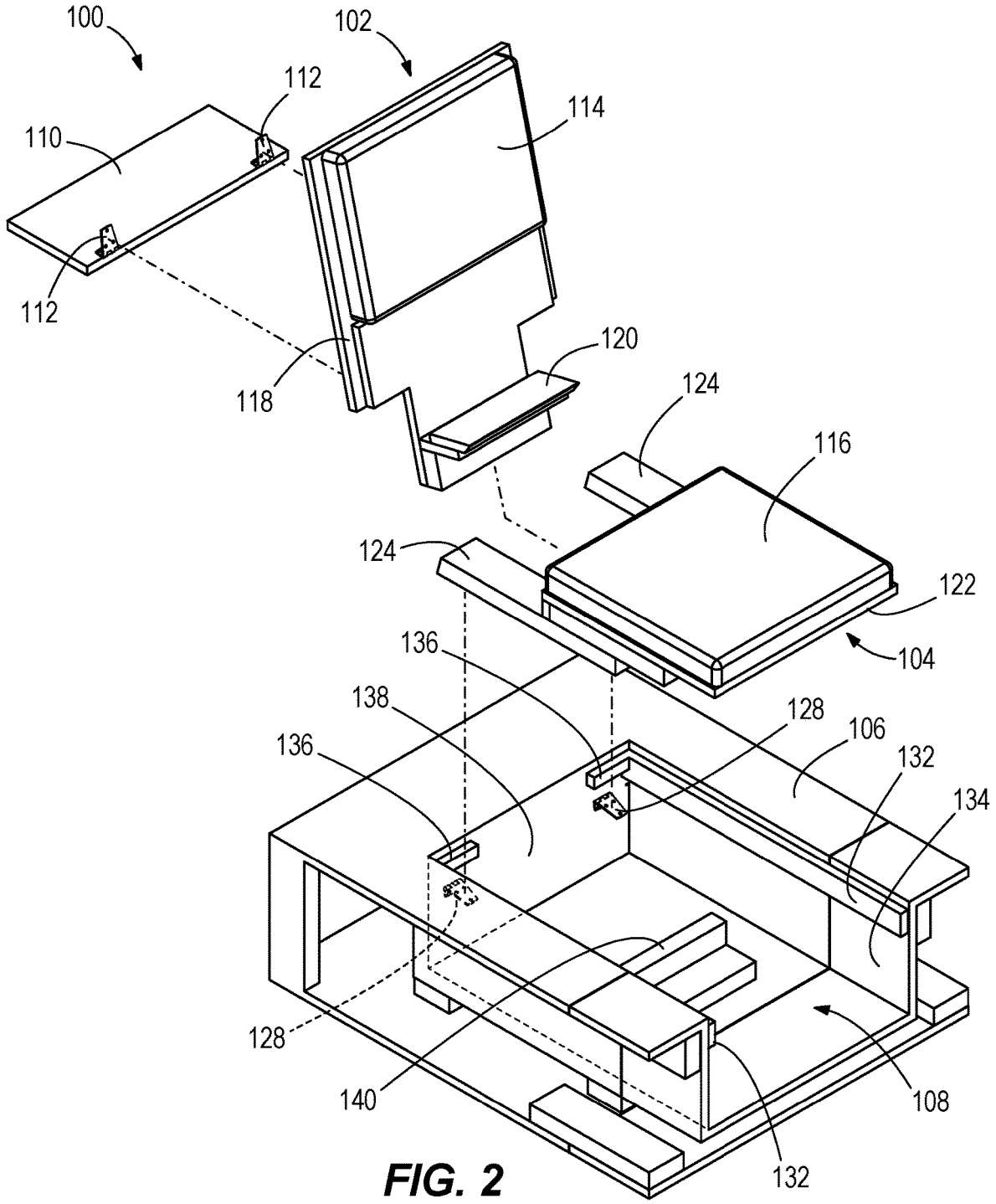
FIG. 2 is an exploded view of the convertible seating system of FIG. 1.
Figure 3:
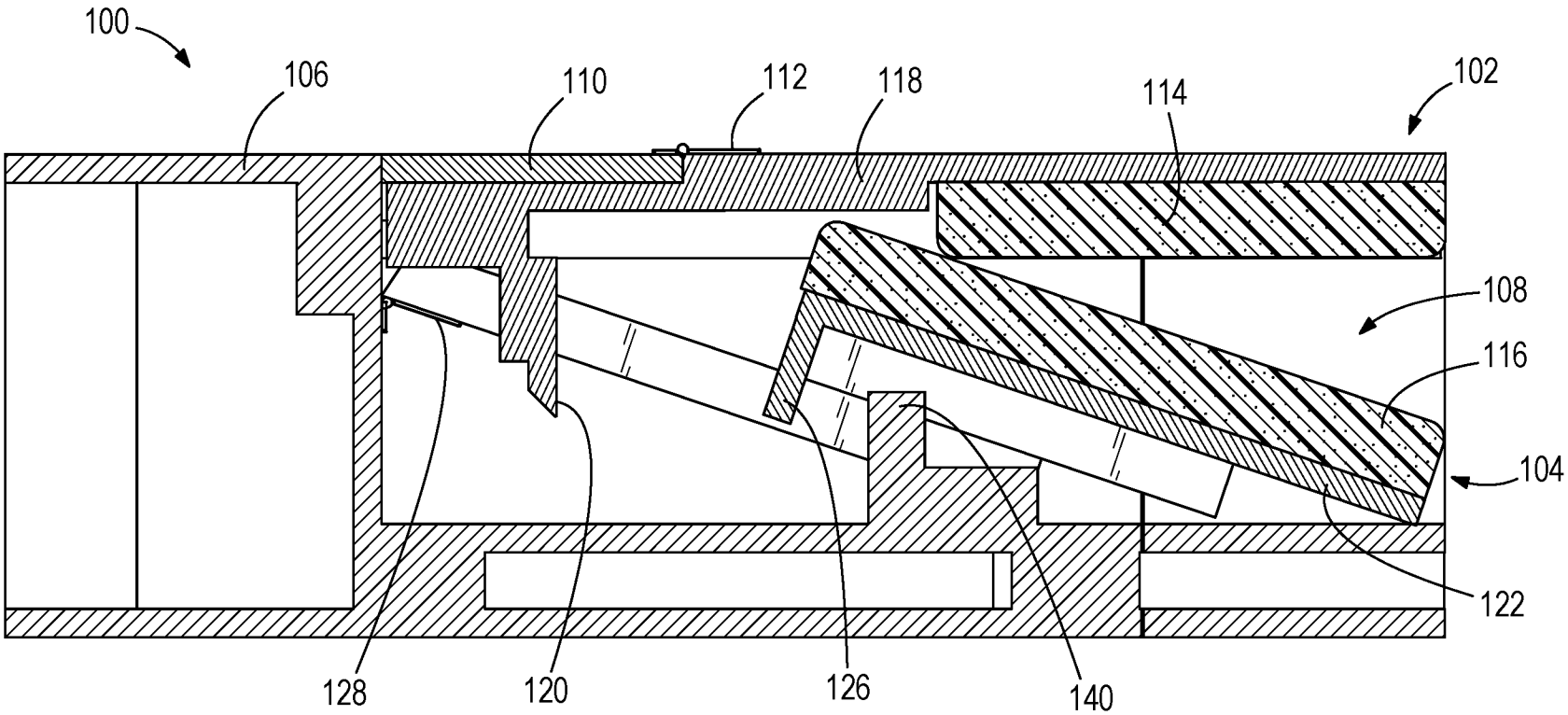
FIG. 3 is a side cross-sectional view of the convertible seating system in the stowed configuration taken along the line 3-3 of FIG. 1.

FIGS. 1-3 illustrate a convertible seating system 100 for a marine vessel in accordance with an exemplary preferred embodiment of the present disclosure. Specifically, FIG. 1 depicts a perspective view of the convertible seating system 100 in a stowed configuration, FIG. 2 depicts an exploded view of the system 100, and FIG. 3 depicts a side cross-sectional view of the system 100 in the stowed configuration. Existing convertible seating systems for marine vessels often include folding backrests that are pivoted downwardly to provide a flat casting sterndeck surface and pivoted upwardly to reveal a seating surface that is recessed below the sterndeck surface. Although simple to implement, the present inventor has recognized that recessed seating surfaces have poor ergonomics and are uncomfortable. Therefore, the convertible seating system of the present disclosure includes a seating base that pivots upwardly as a backrest is pivoted upwardly from a stowed position. In this way, the seating base is raised to a position that is flush or level with the sterndeck surface, rather than recessed, resulting in more favorable ergonomics and a more comfortable seat. Advantageously, as described below, the mechanics of the convertible seating system disclosed herein cause the seating base to be "ratcheted" or automatically raised as the backrest is pivoted, bringing the seating system into a deployed position through a single action performed by the user in raising the backrest.

The convertible seating system 100 is shown to be generally comprised of a backrest component 102 and a ratcheting seat component 104. While in the stowed configuration, a top surface of the backrest component 102 is flush with the deck surface 106, and the seat component 104 resides within a recessed compartment or cavity 108 that is formed in the deck surface 106. In an exemplary implementation, sidewall stop components 132 and back wall ledge components 136 are respectively coupled to the sidewalls 134 and the back wall 138 of the cavity 108, and backrest stop component 140 is positioned within the cavity 108.

The backrest component 102 is shown to be pivotably coupled to a deck component 110 using a pair of aft heavy duty hinges 112. The style of hinges 112 is not particularly limited. By pivotably coupling the backrest component 102 to the deck component 110, the backrest component 102 can be rotated between the stowed position (depicted in FIGS. 1 and 3), and a deployed position (depicted in FIG. 6). A bottom surface of the deck component 110 rests atop the sidewall stop components 132 and the back wall ledge components 136 such that a top surface of the deck component 110 is flush with the deck surface 106. While in the stowed position, a bottom surface of the backrest component 102 likewise rests on the sidewall stop components 132 such that a top surface of the backrest component 102 is flush with the deck surface 106 and the deck component 110, and the backrest component 102 is prevented from pivoting downwardly into the cavity 108.

The convertible seating system 100 is further shown to include a backrest cushion 114 and a seat cushion 116 that increase the comfort and aesthetic qualities of the seating system 100. In an exemplary implementation, the backrest cushion 114 and the seat cushion 116 are fixedly coupled to the backrest component 102 and the seat component 104, respectively. In other implementations, the backrest cushion 114 and the seat cushion 116 are detachably coupled to the backrest component 102 and the seat component 104 using any suitable detachable fastening mechanism (e.g., snaps, magnets, laces or ties).

Specifically referring to FIGS. 2 and 3, the backrest component 102 is shown to include a backrest cushion support portion 118 and a backrest projecting portion 120 that is generally orthogonal to the support portion 118. In various implementations, the support portion 118 and the projecting portion 120 may be fabricated as a single part, or as multiple parts that are assembled to each other. The seat component 104 is shown to include a seat cushion support portion 122, a seat projecting portion 124, and a seat locking projecting portion 126 (see FIG. 3) that is generally orthogonal to the seat cushion support portion 122 and the seat projecting portion 124. In various implementations, the support portion 122, projecting portion 124, and locking portion 126 may be fabricated as a single part, or as multiple parts that are assembled to each other. The seat projecting portion 124 is shown to be pivotably coupled to the recessed deck compartment 108 using a pair of fore heavy duty hinges 128. In an exemplary implementation, the aft hinges 128 are identical to the fore hinges 112.

Figure 4:
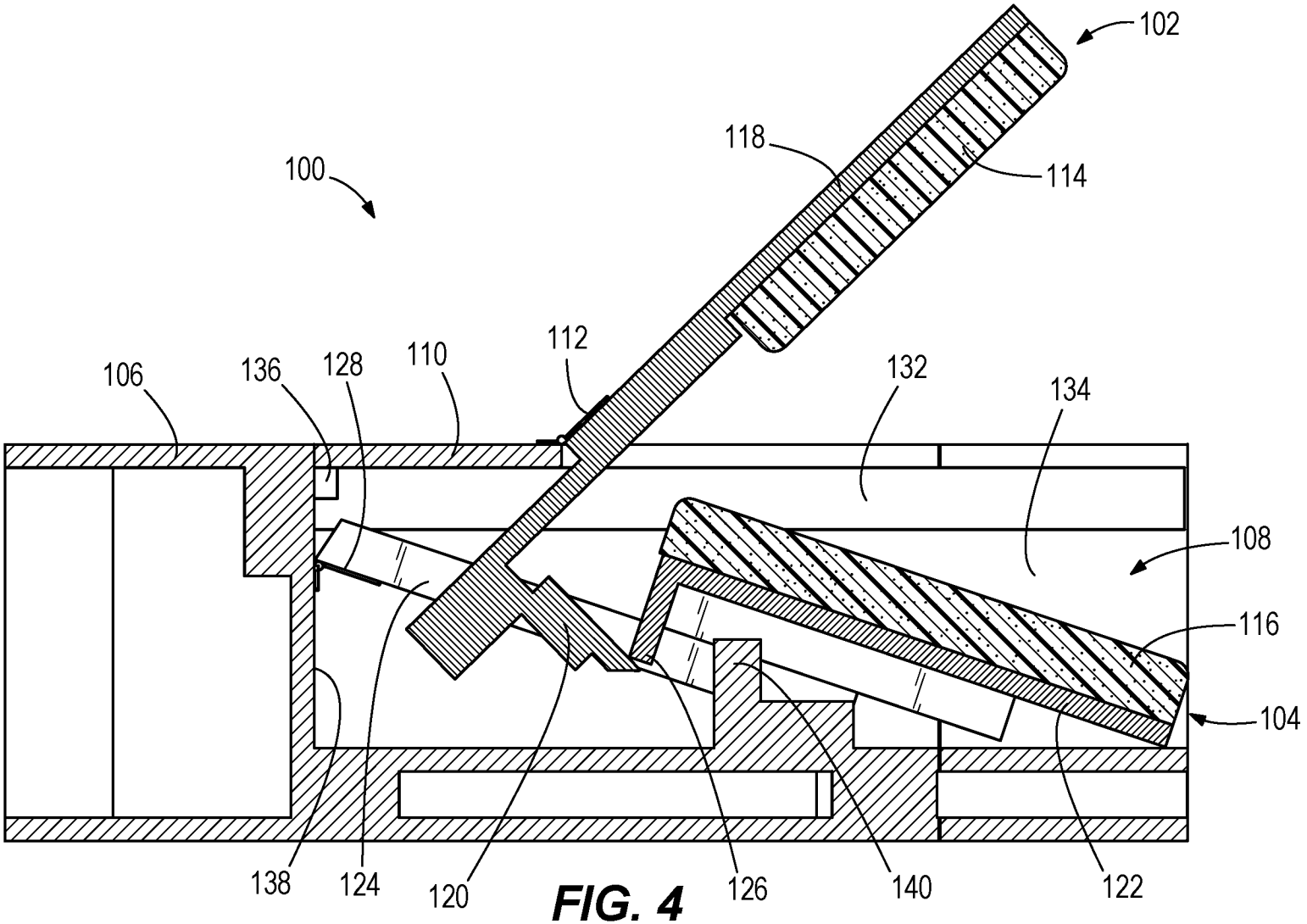
FIG. 4 is a side cross-sectional view of the convertible seating system of FIG. 1 in a partially deployed configuration.
Figure 5:
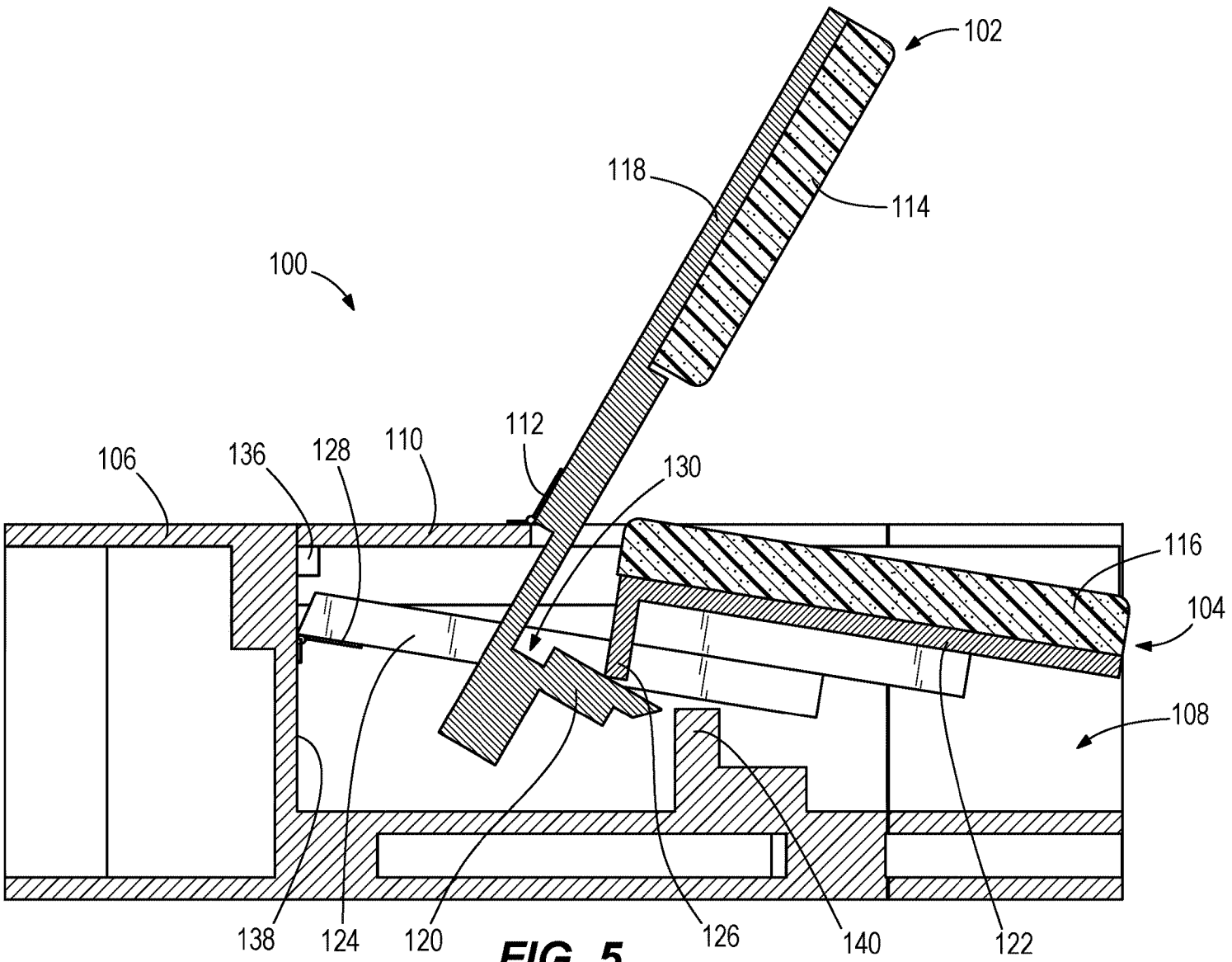
FIG. 5 is another side cross-sectional view of the convertible seating system of FIG. 1 in a partially deployed configuration.

FIGS. 4 and 5 depict the convertible seating system 100 in partially deployed or intermediate configurations as the backrest component 102 is pivoted from the stowed configuration to the deployed configuration. In some implementations, a handle may be provided on the backrest component 102 to assist a user in grasping and pivoting the backrest component 102. As specifically depicted in FIG. 4, as a user pivots the backrest component 102 upwardly, the projecting portion 120 of the backrest component 102 is brought into contact with the locking portion 126 of the seat component 104. As shown in FIG. 5, as the backrest component continues to pivot upwardly, engagement between the locking portion 126 and the projecting portion 120 causes the seat component 104 to likewise pivot upwardly via the hinges 128. The pivoting movement of the seat component 104 causes the locking portion 126 to slide rearwardly relative to the projecting portion 120 until the locking portion 126 rests within a recess 130 that is formed between the backrest cushion support portion 118 and the projecting portion 120 of the backrest component 102 (see FIG. 6).

Figure 6:
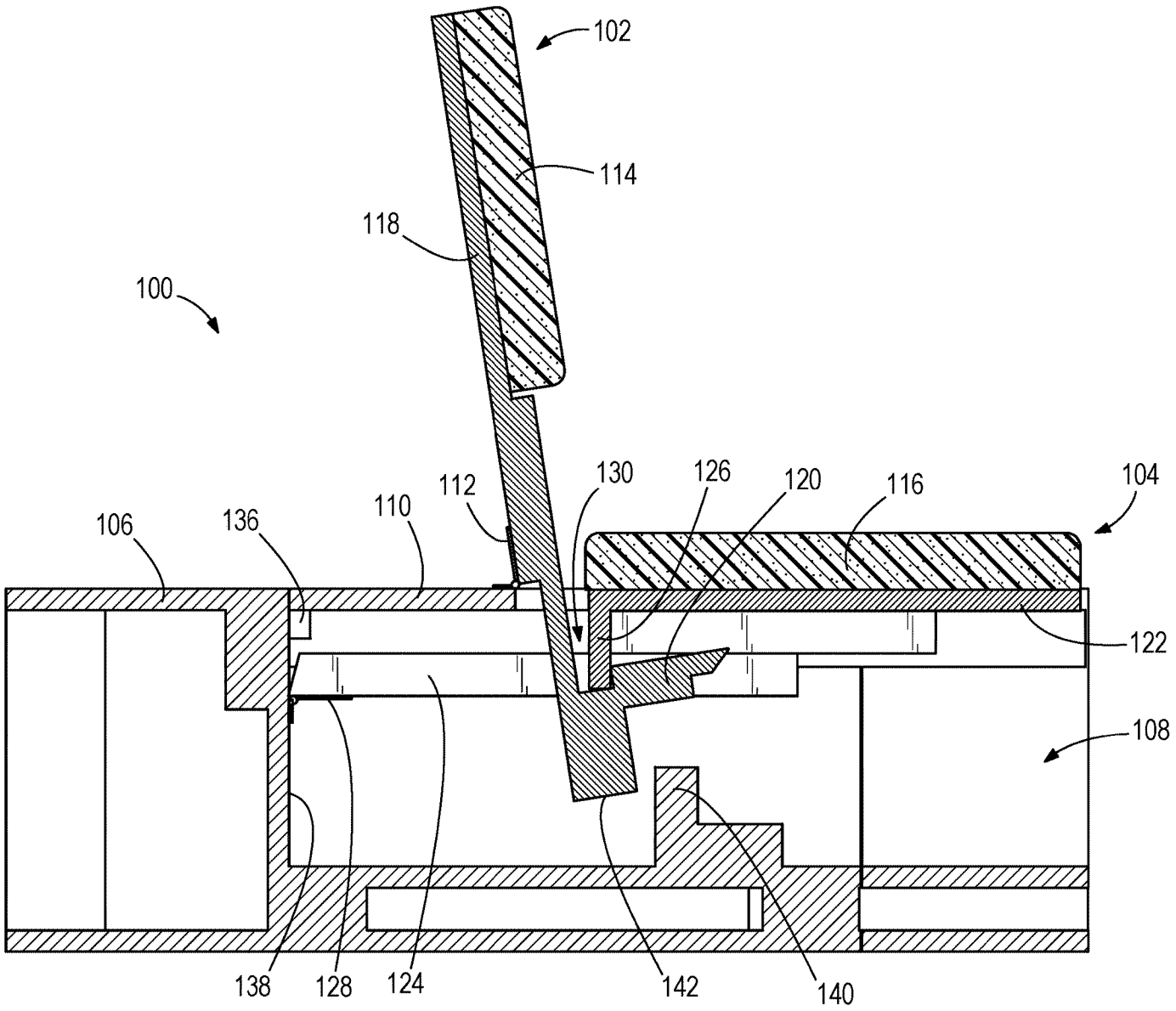
FIG. 6 is a side cross-sectional view of the convertible seating system of FIG. 1 in a fully deployed configuration.

FIG. 6 depicts the convertible seating system 100 in the fully deployed configuration. As described above, in the fully deployed configuration, the ratcheting seat component 104, the deck surface 106, and the deck component 110 are flush or level with each other, resulting in an ergonomically favorable and comfortable seat. Over-rotation or over-reclining of the backrest component 102 in the fully deployed position may be prevented via contact between a lower portion 142 of the backrest support portion 118 and the backrest stop component 140. In some implementations, the projecting portion 120 may include one or more chamfered edges to ensure adequate clearance between the projecting portion 120 as the backrest component 102 rotates between the stowed and deployed configurations.

Figure 7:
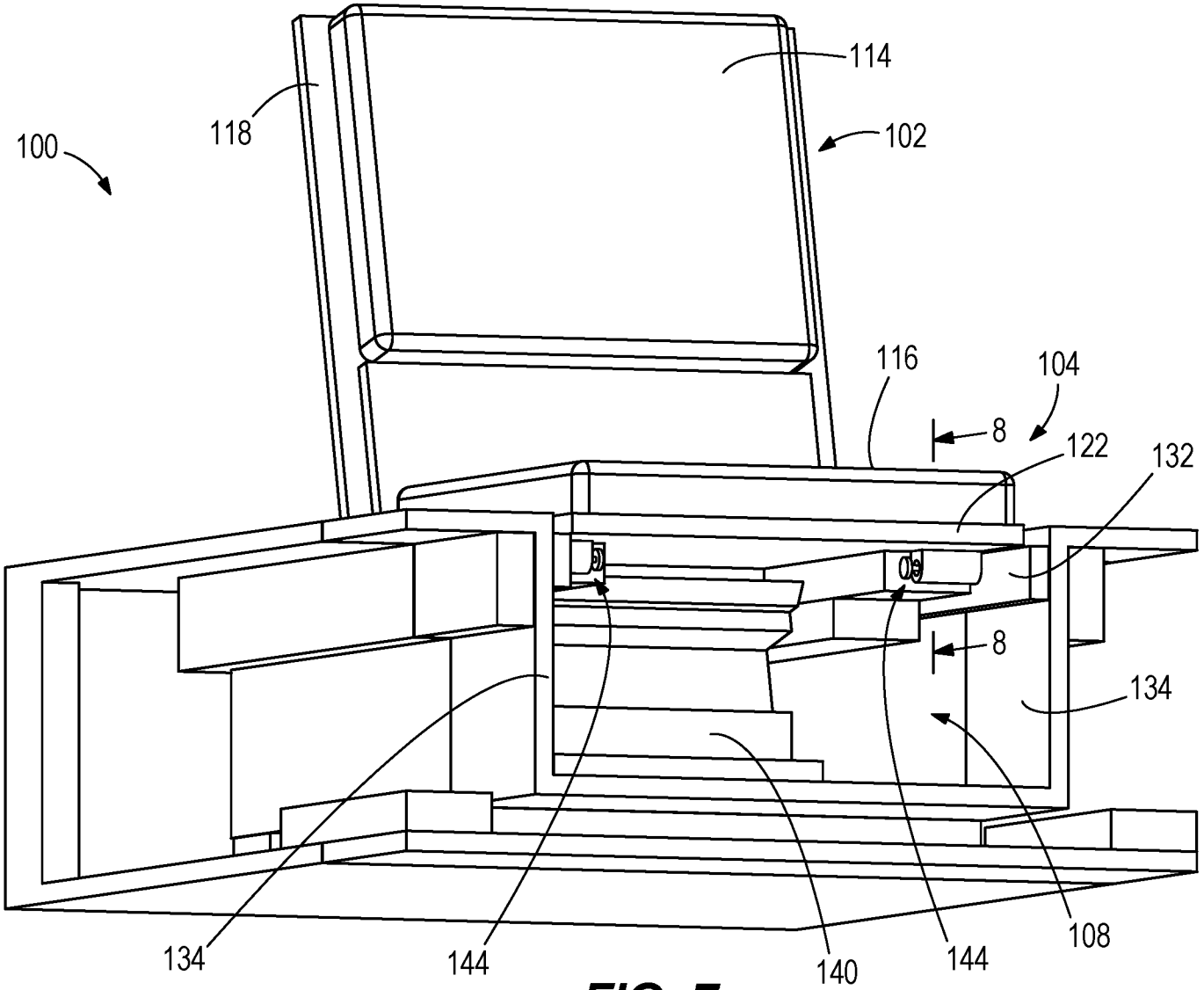
FIG. 7 is a perspective view of a convertible seating system with locking pins in accordance with another exemplary implementation of the present disclosure.
Figure 8:
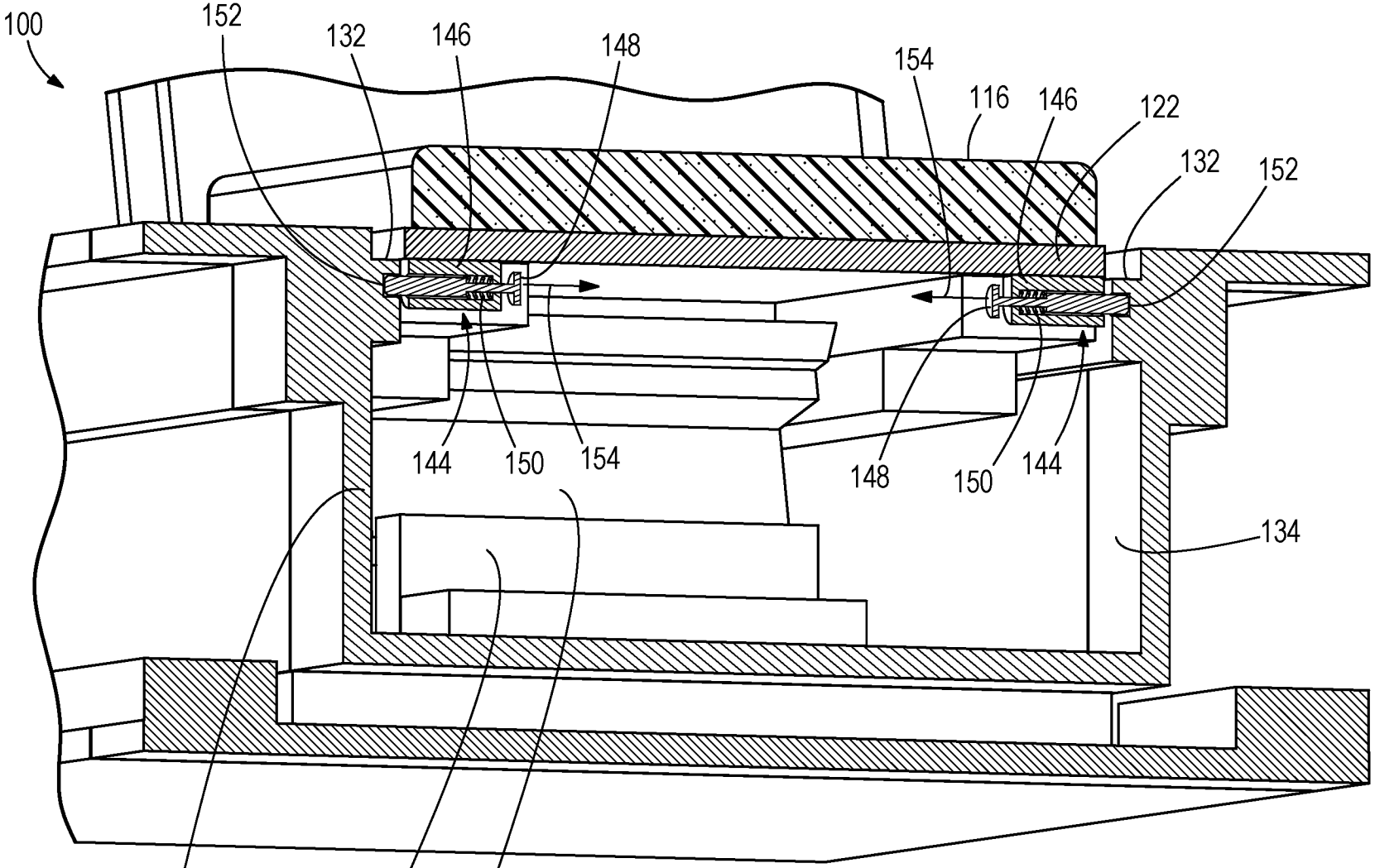
FIG. 8 is a cross-sectional view of the convertible seating system with locking pins taken along the line 8-8 of FIG. 7.

In some implementations, as depicted in FIGS. 7 and 8, the seat component 104 includes at least one locking pin assembly 144 to help retain the convertible seating system 100 in the fully deployed configuration. For example, the seating system 100 may include a pair of pin assemblies 144. Each pin assembly 144 is shown to include a pin retention block 146 that is coupled to the support portion 122 of the seat component 104 and located opposite the seat cushion 116. A retention pin 148 and a spring 150 are shown to be positioned within each pin retention block 146. The springs 150 are configured to bias the retention pins 148 into recesses 152 formed in the sidewall stop components 132. Seating the pins 148 into the recesses 152 arrests movement of the seat component 104 relative to the cavity 108. To rotate the seat component 104 downwardly into the stowed position within the cavity 108, a user pulls the pins 148 inwardly as indicated by arrows 154, compressing the springs 150 and drawing the pins 148 out of the recesses 152.

In the present disclosure, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims.

What is claimed is:

1. A convertible seating system for a marine vessel that is movable between a stowed configuration and a deployed configuration, the convertible seating system comprising:

a backrest component that is pivotably coupled to a deck portion of the marine vessel, the backrest component comprising a backrest cushion support portion and a projecting portion that extends from the backrest cushion support portion; and a seat component that is pivotably coupled to a recessed compartment formed in the deck portion of the marine vessel, the seat component comprising a seat cushion support portion and a locking portion that extends from the seat cushion support portion;

wherein pivoting the backrest component from the stowed configuration to the deployed configuration causes the projecting portion of the backrest component to engage the locking portion of the seat component and the seat component to pivot such that the seat cushion support portion moves upwardly relative to the deck portion in the deployed configuration.

2. The convertible seating system of claim 1, wherein the backrest component further comprises a recess formed between the backrest cushion support portion and the projecting portion.

3. The convertible seating system of claim 2, wherein the locking portion of the seat component is located within the recess of the backrest component when the convertible seating system is in the deployed configuration.

4. The convertible seating system of claim 1, wherein the projecting portion is orthogonal to the backrest cushion support portion.

5. The convertible seating system of claim 1, wherein the locking portion is orthogonal to the seat cushion support portion.

6. The convertible seating system of claim 1, wherein the backrest component is pivotably coupled to the deck portion using at least one backrest hinge.

7. The convertible seating system of claim 6, wherein the seat component is pivotably coupled to the recessed compartment using at least one seat component hinge.

8. The convertible seating system of claim 7, wherein the at least one seat component hinge is coupled to a sidewall of the recessed compartment.

9. The convertible seating system of claim 1, wherein the backrest component is level with the deck portion in the stowed configuration.

10. The convertible seating system of claim 1, wherein pivoting the backrest component from the stowed configuration to the deployed configuration comprises rotating the backrest component more than 90 degrees.

11. The convertible seating system of claim 10, wherein the engagement between the projecting portion of the backrest component and the locking portion of the seat component causes the seat component to rotate less than 90 degrees from the stowed configuration to the deployed configuration.

12. A convertible seating system for a marine vessel that is movable between a stowed configuration and a deployed configuration, the convertible seating system comprising:

a recessed compartment comprising a plurality of sidewalls formed in a deck portion of the marine vessel;

a seat component that is pivotably coupled to one of the plurality of sidewalls;

a deck component that is located above at least a portion of the recessed compartment; and a backrest component that is pivotably coupled to the deck component;

wherein pivoting the backrest component relative to the deck component from the stowed configuration to the deployed configuration engages the seat component to cause the seat component to pivot.

13. The convertible seating system of claim 12, wherein at least a portion of the backrest component is level with the deck portion and the deck component in the stowed configuration.

14. The convertible seating system of claim 12, wherein the seat component is pivotably coupled to the one of the plurality of sidewalls using at least one seat component hinge.

15. The convertible seating system of claim 12, wherein the backrest component is pivotably coupled to the deck component using at least one backrest component hinge.

16. The convertible seating system of claim 12, wherein the backrest component comprises a backrest cushion support portion and a projecting portion that extends orthogonally from the backrest cushion support portion.

17. The convertible seating system of claim 16, wherein the seat component comprises a seat cushion support portion and a locking portion that extends orthogonally from the seat cushion support portion.

18. The convertible seating system of claim 17, wherein the locking portion of the seat component slides along the projecting portion of the backrest component as the convertible seating system moves from the stowed configuration to the deployed configuration.

19. The convertible seating system of claim 18, wherein the backrest component further comprises a recess formed between the backrest cushion support portion and the projecting portion.

20. The convertible seating system of claim 19, wherein the locking portion of the seat component is located within the recess of the backrest component when the convertible seating system is in the deployed configuration.

* * * * *